United States Patent [19]

Ho

[11] 4,051,984

[45] Oct. 4, 1977

[54] COVER FOR A CONTAINER

[75] Inventor: Hoi Ho, Kowloon, Hong Kong

[73] Assignee: Marigold Enterprises Ltd., Kowloon, Hong Kong

[21] Appl. No.: 732,387

[22] Filed: Oct. 14, 1976

[30] Foreign Application Priority Data

Oct. 14, 1975 United Kingdom ..... 42040/75

[51] Int. Cl.[2] ..... B65D 23/06

[52] U.S. Cl. ..... 222/471; 222/518; 222/571

[58] Field of Search ..... 222/109, 110, 111, 510, 222/571, 566, 479, 518, 545, 471, 500

[56] References Cited

U.S. PATENT DOCUMENTS

| | | | |
|---|---|---|---|
| 2,676,472 | 4/1954 | Paddock | 222/111 |
| 3,146,913 | 9/1964 | Nagai | 222/110 |

*Primary Examiner*—Stanley H. Tollberg
*Assistant Examiner*—Hadd Lane

[57] ABSTRACT

The invention relates to a closure which can be fitted to a container and which has an opening to enable the contents of a container to be poured therefrom, the closure comprising an end wall portion, a peripheral wall portion extending from one side of the end wall portion, a wall spaced from the peripheral wall portion and extending from the end wall portion, a drain communicating between the wall portion, means for attaching the cover to a container, a pouring opening in the peripheral wall portion, an aperture in said spaced wall aligned with the pouring opening and having a cross-sectional area less than that of the pouring opening, and a manually movable closure member which can be moved between a position in which it closes the aperture and a position in which the aperture is open.

13 Claims, 3 Drawing Figures

FIG. 1.
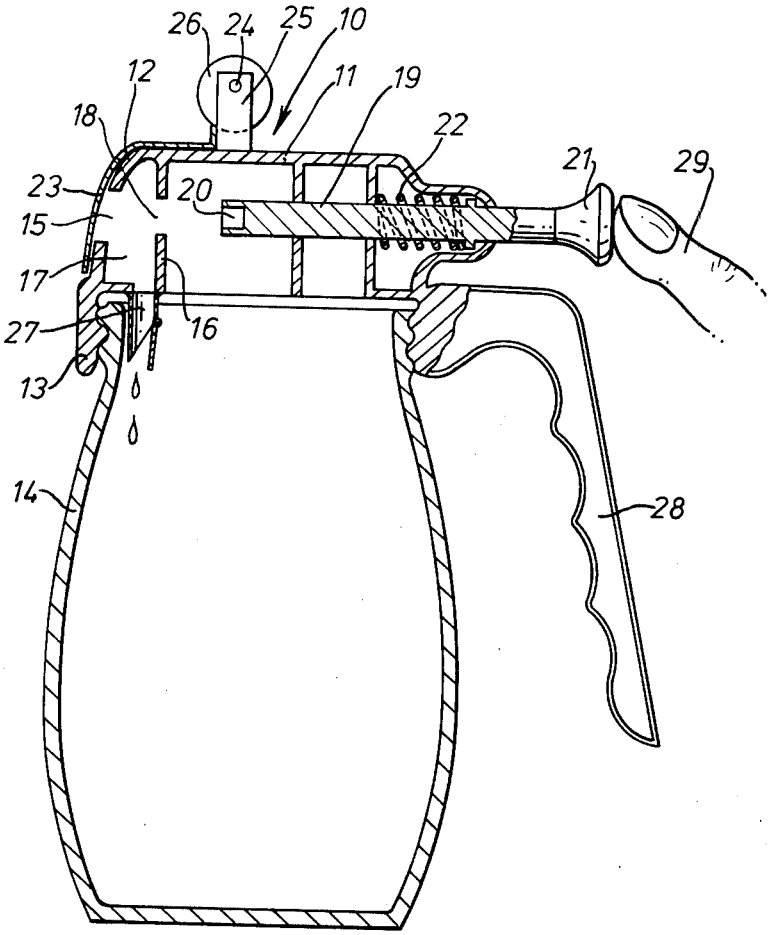
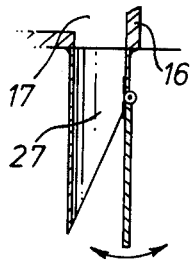
FIG. 2.

COVER FOR A CONTAINER

BACKGROUND OF THE INVENTION

Containers for liquid foodstuffs which are sticky, such as syrup, honey and condensed milk require a closure which will allow the contents to be poured therefrom without the closure having to be removed. Due to the sticky and sweet properties of such foodstuffs it is undesirable for traces of the foodstuff to be left around the pouring opening after use as this tends to drip down the outside of the container and attracts insects such as flies, wasps, bees and ants.

It is known to provide containers, such as jugs, with removable closures having a pouring opening therein but the liquid foodstuff tends to accumulate around the pouring opening after use and drips down the outside of the container.

SUMMARY OF THE IVENTION

This invention relates generally as indicated to a closure for a container and in particular a closure having an opening to enable the contents of a container to be poured therefrom. The invention also relates to a container provided with such a closure.

An object of the invention is to provide a closure for containers for liquid foodstuffs which are sticky, such as syrup, honey and condensed milk, which will allow the contents to be poured therefrom without the closure having to be removed. Another object of the invention is to provide a closure in which no traces of the foodstuff are left around the pouring opening after use.

According to the present invention there is provided a closure for a container, comprising an end wall portion, a peripheral wall portion extending from one side of said end wall portion, a wall spaced from said peripheral wall portion and extending from said end wall portion, means for attaching the cover to a container, a pouring opening in said peripheral wall portion, an aperture in said spaced wall aligned with said pouring opening and having a cross-sectional area less than that of said pouring opening, and a manually movable closure member which can be moved between a position in which it closes said aperture and a position in which the aperture is open.

The manually movable closure member preferably comprises a rod which extends through the peripheral wall and is aligned with the aperture in the spaced wall. The rod is preferably movable towards the aperture against the loading of resilient means such as a spring.

The closure can be provided with a handle. The space formed between the peripheral wall portion and the internal wall can be drained to beneath the cover via a one-way valve.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail a certain illustrative embodiment of the invention, this being indicative of but one way in which the principle of the invention may be employed.

In said annexed drawings:

FIG. 1 is a cross-sectional view of a cover according to the present invention mounted on a container, FIG. 2 is a view on a larger scale of the non-return valve.

DESCRIPTION OF THE PREFERRED EMBODIMENT

Figure 3:
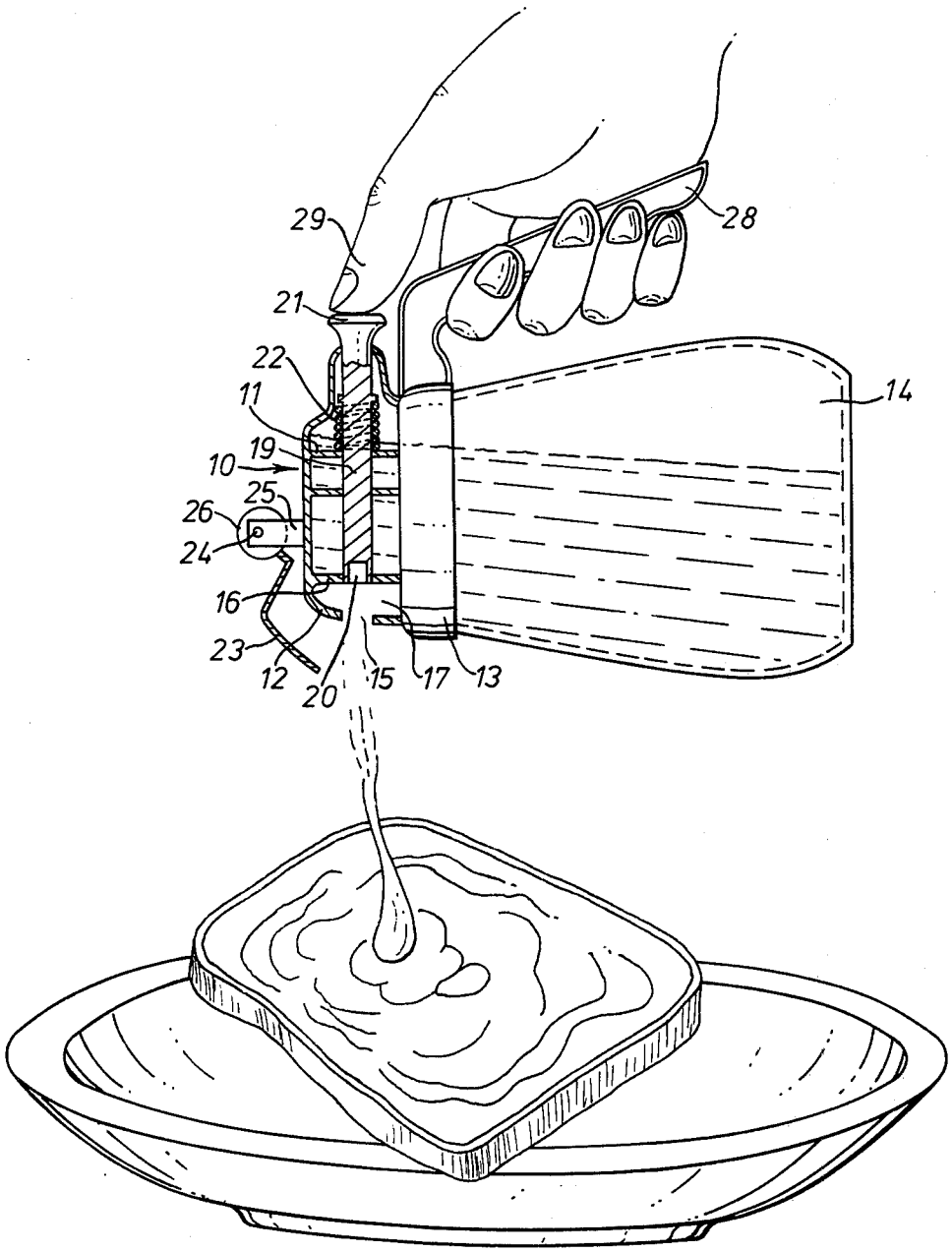
FIG. 3 is a side elevation of the cover and container, partly in section, in the pouring position.

The closure comprises a cover portion 10 having an end wall portion 11 and a peripheral wall portion 12. The peripheral wall portion 12 is provided with a downwardly extending annular portion 13 provided with an internal screw-thread which engages with an external screw-thread provided on the upper end of a container 14. Alternatively the annular portion 13 can be attached to the container 14 by a bayonet-type connection or any other suitable connection. The peripheral wall portion 12 is provided with a pouring opening 15.

Extending downwardly from the end wall portion, as viewed in the drawings, is an internal wall 16 which is spaced from that part of the peripheral wall portion 12 having the pouring opening 15 to form a chamber 17. An aperture 18 is provided in the internal wall 16. The aperture 18 is aligned with the pouring opening 15 and has a cross-sectional area which is less than the cross-sectional area of the pouring opening 15.

Mounted on the cover portion 10 and extending through the peripheral wall portion 12 is a round rod 19 which is axially aligned with the aperture 18. The rod 19 has a hollow end 20 and is provided at its outer end with a button 21.

Located within the cover portion 10 is a spring 22 which acts on the rod 19 to urge it to a position in which the hollow end 20 is spaced from the aperture 18.

Mounted on the cover portion 10 is a closure flap member 23 which closes off the outlet of the pouring opening 15 when the closure is in a non-pouring position. The closure flap member 23 is pivotable about an axle 24 mounted on a support 25 provided on the outside of the end wall portion 11. Attached to the axle 24 is a weight 26 which is eccentrically mounted so that when the closure is moved to the pouring position, as shown in FIG. 3, the closure flap member 23 will automatically be moved away from the pouring opening 15.

The chamber 17 is drained to beneath the cover, i.e. to the interior of the container 14, via a non-return valve 27.

Extending from the annular wall portion 13 is a handle 28 but it will be appreciated that this is not necessary if the container 14 is provided with a handle. In order to pour the contents from the container 14 the container 14 is lifted by the handle and tilted to the position shown in FIG. 3. The closure flap member 23 will automatically swing away from the pouring outlet 15 due to the weight 26 and the contents of the container 14 will flow through the aperture 18 and pass through the pouring outlet 15 without touching the periphery of the pouring outlet 15. The contents of the container 14 cannot flow directly from the container 14 into the chamber 17 due to the non-return valve 27. When the desired quantity of the contents have been discharged through the pouring outlet 15 the button 21 is depressed by the thumb 29 of the user so that the rod 19 is moved against the pressure of the spring 22. The hollow end 20 of the rod 19 has a sharp edge and it cleanly cuts off the flow through the aperture 18. The container 14 is then brought to the upright non-pouring position of FIG. 1 and the button 21 is released so that the spring 22 returns the rod 19 to its original position. The closure flap member 23 automatically returns to its closed position.

Any of the contents which drip from the aperture 18 into the chamber 17 are discharged back into the container 14 through the valve 27.

With such a closure the contents of a container can be poured from a container without the pouring outlet becoming covered with the contents and contents are not left around the pouring outlet after use.

I, therefore, particularly point out and distinctly claim as my invention:

1. A closure for a container, comprising an end wall portion, a peripheral wall portion extending from one side of said end wall portion, a wall spaced from said peripheral wall portion and extending from said end wall portion, means for attaching the cover to a container, a pouring opening in said peripheral wall portion, an aperture in said spaced wall aligned with said pouring opening and having a cross-sectional area less than that of said pouring opening, and a manually movable closure member which can be moved between a position in which it closes said aperture and a position in which the aperture is open.

2. A closure as claimed in claim 1, in which said manually movable closure member comprises a rod which extends through said peripheral wall and is aligned with said aperture in the spaced wall.

3. A closure as claimed in claim 1, in which the closure member is movable towards said aperture against the loading of resilient means.

4. A closure as claimed in claim 3, in which said resilient means consists of a spring.

5. A closure as claimed in claim 1, in which the closure member comprises a rod which extends through said peripheral wall, one end of the rod being aligned with the aperture and being hollow.

6. A closure as claimed in claim 5, in which the hollow end of the rod has a sharp edge.

7. A closure as claimed in claim 1, in which the space formed between the peripheral wall portion and said spaced wall is drained by a one-way valve.

8. A closure as claimed in claim 1, in which the space formed between the peripheral wall portion and said spaced wall is drained by a one-way valve, and said valve is a flap valve.

9. A closure as claimed in claim 1 provided with a closure flap member for closing said pouring opening.

10. A closure as claimed in claim 1, provided with a closure flap member for closing said pouring opening, said closure flap member being pivotably mounted on the end wall by a hinge pin and the hinge pin is provided with an eccentric weight.

11. A closure as claimed in claim 1, provided with a handle.

12. A closure as claimed in claim 1, in which said means for attaching the cover to a container comprises an internally screw-threaded annular portion extending below said peripheral wall.

13. In combination a container provided with an opening at one end, said opening being covered by a closure comprising an end wall portion, a peripheral wall portion extending from one side of said end wall portion, a wall spaced from said peripheral wall portion and extending from said end wall portion, means for attaching the cover to a container, a pouring opening in said peripheral wall portion, an aperture in said spaced wall aligned with said pouring opening and having a cross-sectional area less than that of said pouring opening, and a manually movable closure member which can be moved between a position in which it closes said aperture and a position in which the aperture is open.

* * * * *